US011741901B1

(12) United States Patent
Zhou et al.

(10) Patent No.: US 11,741,901 B1
(45) Date of Patent: Aug. 29, 2023

(54) PIXEL DRIVE CIRCUIT AND DISPLAY PANEL

(71) Applicant: HKC Corporation Limited, Guangdong (CN)

(72) Inventors: Renjie Zhou, Guangdong (CN); Baohong Kang, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 18/090,117

(22) Filed: Dec. 28, 2022

(30) Foreign Application Priority Data

May 12, 2022 (CN) ..... 202210515982.2

(51) Int. Cl.
*G09G 3/3258* (2016.01)
*G09G 3/3266* (2016.01)

(52) U.S. Cl.
CPC ..... *G09G 3/3258* (2013.01); *G09G 3/3266* (2013.01); *G09G 2300/0857* (2013.01); *G09G 2310/0264* (2013.01); *G09G 2310/061* (2013.01)

(58) Field of Classification Search
CPC .. G09G 3/3258; G09G 3/3266; G09G 3/3233; G09G 3/3291; G09G 2310/0264; G09G 2310/061; G09G 2300/0857
See application file for complete search history.

(56) References Cited

U.S. PATENT DOCUMENTS 10,565,933 B2 * 2/2020 Zheng ..... G09G 3/3258

FOREIGN PATENT DOCUMENTS

| | | |
|---|---|---|
| CN | 103871356 A | 6/2014 |
| CN | 107945737 A | 4/2018 |
| CN | 113362765 A | 9/2021 |
| CN | 114822396 A | 7/2022 |

OTHER PUBLICATIONS

International Search Report dated Dec. 8, 2022 received in International Application No. PCT/CN2022/122890.

* cited by examiner

*Primary Examiner* — Sardis F Azongha
(74) *Attorney, Agent, or Firm* — Scully, Scott, Murphy & Presser, P.C.

(57) ABSTRACT

A pixel drive circuit is provided. The pixel drive circuit includes a light-emitting element, a drive transistor, a reset loop, a first capacitor, a first switch tube, a second capacitor, a pre-charge module, and a threshold compensation loop. The drive transistor is coupled with the light-emitting element. The reset loop is conductive in a reset phase to reset a voltage at a control end of the drive transistor. The pre-charge module is configured to charge the second capacitor to a first voltage in the reset phase. The threshold compensation loop includes the first capacitor, the drive transistor, and the first switch tube. A voltage at a control end of the first switch tube coupled with the second capacitor is raised continuously from the first voltage according to a first scan signal, to conduct the threshold compensation loop to compensate for a threshold voltage of the drive transistor.

20 Claims, 11 Drawing Sheets

PIXEL DRIVE CIRCUIT AND DISPLAY PANEL

CROSS-REFERENCE TO RELATED APPLICATIONS

This application claims priority under 35 U.S.C. § 119(a) to Chinese Patent Application No. 202210515982.2, filed May 12, 2022, the entire disclosure of which is incorporated herein by reference.

TECHNICAL FIELD

This application relates to the field of display technology, and particularly to a pixel drive circuit and a display panel.

BACKGROUND

Organic Light-Emitting Diode (OLED) displays have advantages of low power consumption, fast response speed, wide viewing angle, etc., and therefore are becoming more and more widespread. According to a driving method, OLED display devices can be classified into two categories: Passive Matrix OLED (PMOLED) and Active Matrix OLED (AMOLED).

For an AMOLED display panel, pixel drive circuits are arranged in an array. The early pixel drive circuit has a 2T1C structure, that is, each pixel drive circuit includes two transistors (T) and one capacitor (C). However, there is a problem of threshold-voltage drift in transistors. In order to solve the problem of threshold-voltage drift in transistors, a 5T2C pixel drive circuit, a 7T1C pixel drive circuit, a 8T1C pixel drive circuit, and other types of pixel drive circuits with threshold-voltage compensation are emerged. However, since a threshold-voltage compensation phase is introduced in each frame of scan period, one frame of scan period is relatively long, a charging speed of the pixel drive circuit is relatively slow, which is not conducive to achieving a high refresh rate.

SUMMARY

The disclosure provides a pixel drive circuit. The pixel drive circuit includes a light-emitting element, a drive transistor, a reset loop, a first capacitor, a first switch tube, a second capacitor, a pre-charge module, and a threshold compensation loop. A first end of the light-emitting element is electrically coupled with a reference-voltage end. The pixel drive circuit is configured to drive the light-emitting element to emit lights. The drive transistor is electrically coupled with a second end of the light-emitting element. A first end of the first capacitor is electrically coupled with a control end of the drive transistor. The first capacitor is arranged in the reset loop. The reset loop is conductive in a reset phase to receive a reset voltage, to charge the first capacitor to raise a voltage at the first end of the first capacitor, so as to reset a voltage at the control end of the drive transistor to the reset voltage through the first capacitor. The first switch tube is coupled in parallel at two ends of the light-emitting element. A first end of the second capacitor is electrically coupled with a control end of the first switch tube. The pre-charge module is electrically coupled with the first end of the second capacitor, and configured to charge the second capacitor in the reset phase to raise a voltage at the first end of the second capacitor to a first voltage, where the first voltage is lower than a sum of a voltage at the reference-voltage end and a threshold voltage of the first switch tube. The threshold compensation loop includes the first capacitor, the drive transistor, and the first switch tube which are electrically coupled in series. The second capacitor continues to be charged according to a first scan signal in a threshold compensation phase, such that a voltage at the control end of the first switch tube is raised continuously from the first voltage to switch on the first switch tube, so as to conduct the threshold compensation loop. The first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

The disclosure further provides a display panel. The display panel includes a substrate and multiple pixel drive circuits. The substrate has a display region. The multiple pixel drive circuits are arranged in an array in the display region of the substrate. The pixel drive circuit includes a light-emitting element, a drive transistor, a reset loop, a first capacitor, a first switch tube, a second capacitor, a pre-charge module, and a threshold compensation loop. A first end of the light-emitting element is electrically coupled with a reference-voltage end. The pixel drive circuit is configured to drive the light-emitting element to emit lights. The drive transistor is electrically coupled with a second end of the light-emitting element. A first end of the first capacitor is electrically coupled with a control end of the drive transistor. The first capacitor is arranged in the reset loop. The reset loop is conductive in a reset phase to receive a reset voltage, to charge the first capacitor to raise a voltage at the first end of the first capacitor, so as to reset a voltage at the control end of the drive transistor to the reset voltage through the first capacitor. The first switch tube is coupled in parallel at two ends of the light-emitting element. A first end of the second capacitor is electrically coupled with a control end of the first switch tube. The pre-charge module is electrically coupled with the first end of the second capacitor, and configured to charge the second capacitor in the reset phase to raise a voltage at the first end of the second capacitor to a first voltage, where the first voltage is lower than a sum of a voltage at the reference-voltage end and a threshold voltage of the first switch tube. The threshold compensation loop includes the first capacitor, the drive transistor, and the first switch tube which are electrically coupled in series. The second capacitor continues to be charged according to a first scan signal in a threshold compensation phase, such that a voltage at the control end of the first switch tube is raised continuously from the first voltage to switch on the first switch tube, so as to conduct the threshold compensation loop. The first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

REFERENCE SIGNS OF MAIN COMPONENTS

Figure 1:
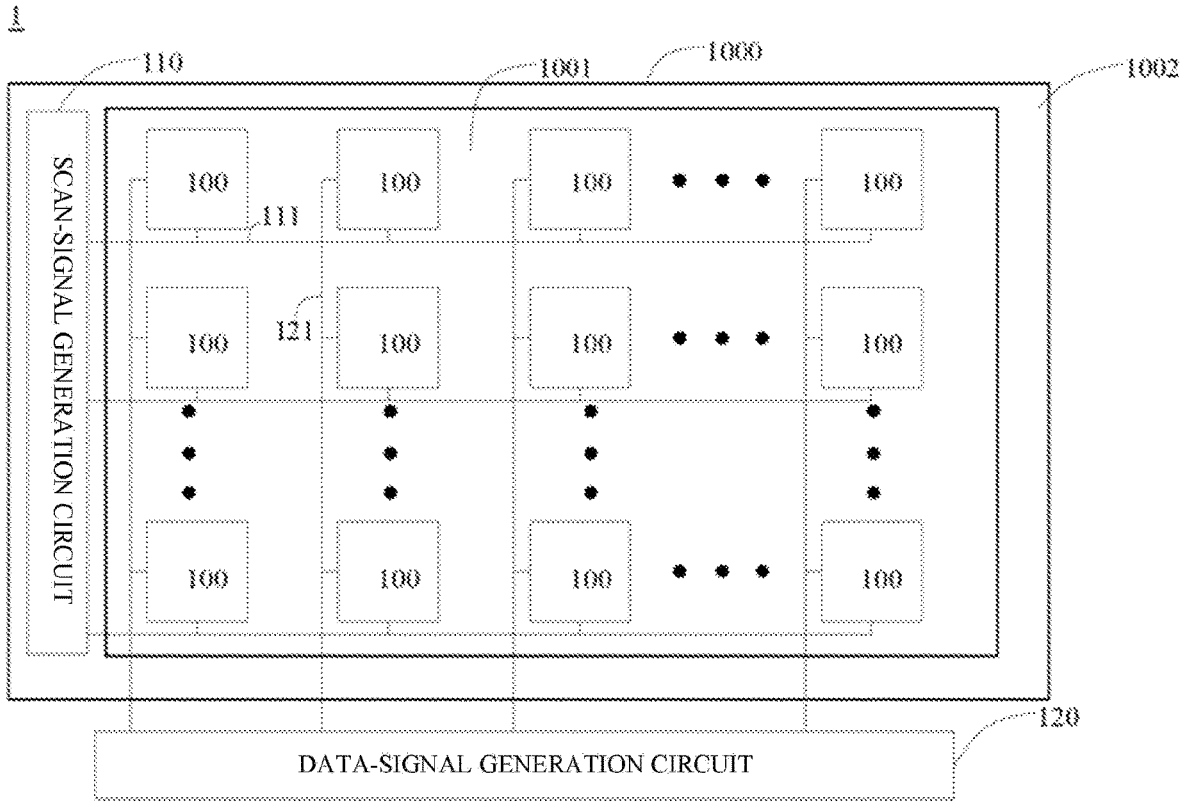
FIG. 1 is a schematic structural diagram illustrating a display panel provided in implementations of the disclosure.

| | |
|---|---|
| display panel | 1 |
| reference-voltage end | VSS |
| substrate | 1000 |
| display region | 1001 |
| non-display region | 1002 |
| pixel drive circuit | 100 |
| scan-signal generation circuit | 110 |
| scan line | 111 |
| data-signal generation circuit | 120 |
| data line | 121 |
| light-emitting element | OLED |
| T flip flop | U1 |
| D flip flop | U2 |
| reset loop | L1 |
| threshold compensation loop | L2 |
| data-writing loop | L3 |
| light-emitting loop | L4 |
| pre-charge module | 10 |
| switch-on signal generation module | 101 |
| first node | G1 |
| second node | G2 |
| inverter | D1 |
| drive transistor | M |
| first switch tube | T1 |
| second switch tube | T2 |
| third switch tube | T3 |
| fourth switch tube | T4 |
| fifth switch tube | T5 |
| sixth switch tube | T6 |
| seventh switch tube | T7 |
| first capacitor | C1 |
| second capacitor | C2 |

The disclosure will be further depicted below with reference to specific implementations and accompanying drawings.

DETAILED DESCRIPTION

Hereinafter, technical solutions of implementations of the disclosure will be depicted in a clear and comprehensive manner with reference to accompanying drawings intended for these implementations. Apparently, implementations described below merely illustrate some implementations, rather than all implementations, of the disclosure. All other implementations obtained by those of ordinary skill in the art based on the implementations of the disclosure without creative efforts shall fall within the protection scope of the disclosure.

In description of the disclosure, it should be noted that, orientations or positional relationships indicated by the terms "upper", "lower", "left", "right", and the like are based on orientations or positional relationships illustrated in the accompanying drawings, and are only for convenience of describing the disclosure and simplifying the description, rather than indicating or implying that the referred device or element must have a specific orientation, be constructed and operated in a specific orientation, and therefore should not be construed as a limitation of the disclosure. In addition, the terms "first", "second", and the like are used for descriptive only and should not be construed to indicate or imply relative importance.

In view of this, the disclosure provides a pixel drive circuit and a display panel, which aim to solve problems of a long scan period, a slow charging speed, and a low refresh rate in the existing pixel drive circuit.

The disclosure provides a pixel drive circuit. The pixel drive circuit includes a light-emitting element, a drive transistor, a reset loop, a first capacitor, a first switch tube, a second capacitor, a pre-charge module, and a threshold compensation loop. A first end of the light-emitting element is electrically coupled with a reference-voltage end. The pixel drive circuit is configured to drive the light-emitting element to emit lights. The drive transistor is electrically coupled with a second end of the light-emitting element. A first end of the first capacitor is electrically coupled with a control end of the drive transistor. The first capacitor is arranged in the reset loop. The reset loop is conductive in a reset phase to receive a reset voltage, to charge the first capacitor to raise a voltage at the first end of the first capacitor, so as to reset a voltage at the control end of the drive transistor to the reset voltage through the first capacitor. The first switch tube is coupled in parallel at two ends of the light-emitting element. A first end of the second capacitor is electrically coupled with a control end of the first switch tube. The pre-charge module is electrically coupled with the first end of the second capacitor, and configured to charge the second capacitor in the reset phase to raise a voltage at the first end of the second capacitor to a first voltage, where the first voltage is lower than a sum of a voltage at the reference-voltage end and a threshold voltage of the first switch tube. The threshold compensation loop includes the first capacitor, the drive transistor, and the first switch tube which are electrically coupled in series. The second capacitor continues to be charged according to a first scan signal in a threshold compensation phase, such that a voltage at the control end of the first switch tube is raised continuously from the first voltage to switch on the first switch tube, so as to conduct the threshold compensation loop. The first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

According to the pixel drive circuit of the disclosure, the first end of the second capacitor is pre-charged to the first voltage through the pre-charge module in the reset phase, therefore, when receiving the first scan signal, the second capacitor can continue to be charged from the first voltage, rather than being charged from an initial low level. As such, a duration of the threshold compensation phase can be shortened, that is, each frame of scan period can be shortened, which is conducive to realizing a high refresh rate.

Optionally, the pre-charge module includes a second switch tube and a switch-on signal generation module. A first connection end of the second switch tube is configured to receive a charging voltage, and a second connection end of the second switch tube is electrically coupled with the control end of the first switch tube. The switch-on signal generation module is electrically coupled with a control end of the second switch tube and configured to generate a switch-on signal within a preset time period in the reset phase to switch on the second switch tube, such that the second capacitor can be charged by receiving the charging voltage through the switched-on second switch tube, and the first end of the second capacitor is charged to the first voltage.

Optionally, the switch-on signal generation module includes a T flip-flop. A clock-signal end of the T flip flop is configured to receive a first clock signal within the preset time period in the reset phase, an input end of the T flip flop is configured to receive a high-level voltage, an output end of the T flip flop is electrically coupled with the control end of the second switch tube, and a duration of the first clock signal is two preset clock cycles. The T flip flop is configured to generate and output the switch-on signal within the preset time period in the reset phase in response to the first clock signal.

Optionally, the switch-on signal generation module includes a D flip-flop and an inverter. A clock-signal end of the D flip flop is configured to receive a second clock signal within the preset time period in the reset phase, an output end of the D flip flop is electrically coupled with the control end of the second switch tube, and a duration of the second clock signal is three preset clock cycles. An input end of the inverter is electrically coupled with the output end of the D flip flop, and an output end of the inverter is electrically coupled with an input end of the D flip flop. The D flip flop is configured to generate and output the switch-on signal within the preset time period in the reset phase in response to the second clock signal.

Optionally, the reset loop further includes a third switch tube, a fourth switch tube, and a fifth switch tube. The third switch tube, the fourth switch tube, the first capacitor, and the fifth switch tube are sequentially coupled in series. A first connection end of the third switch tube is configured to receive the reset voltage in the reset phase, and a second connection end of the third switch tube is electrically coupled with the drive transistor. The fourth switch tube is electrically coupled between the second connection end of the third switch tube and the control end of the drive transistor. The fifth switch tube is electrically coupled between a second end of the first capacitor and the reference-voltage end. In the reset phase, the third switch tube is switched on according to a second scan signal received at a control end of the third switch tube, the fourth switch tube is switched on according to a third scan signal received at a control end of the fourth switch tube, and the fifth switch tube is switched on according to the third scan signal received at a control end of the fifth switch tube, to conduct the reset loop.

Optionally, the threshold compensation loop further includes the fourth switch tube and the fifth switch tube. In the threshold compensation phase, the fourth switch tube is switched on according to the third scan signal received at the control end of the fourth switch tube, and the fifth switch tube is switched on according to the third scan signal received at the control end of the fifth switch tube, to conduct the threshold compensation loop.

Optionally, the pixel drive circuit further includes a data-writing loop. The data-writing loop includes a sixth switch tube and the first capacitor which are electrically coupled in series. A first connection end of the sixth switch tube is configured to receive a data voltage, and a second connection end of the sixth switch tube is electrically coupled with the second end of the first capacitor. In a data-writing phase, the fifth switch tube is switched off, and the sixth switch tube is switched on according to a fourth scan signal received at a control end of the sixth switch tube, to conduct the data-writing loop to pull up a voltage at the second end of the first capacitor to the data voltage.

Optionally, the pixel drive circuit further includes a light-emitting loop. The light-emitting loop includes the third switch tube, the drive transistor, and the light-emitting element which are sequentially coupled in series. In a light-emitting phase, the third switch tube is switched on according to the second scan signal received at the control end of the third switch tube, to conduct the light-emitting loop to receive a drive voltage to drive the light-emitting element to emit lights.

Optionally, the light-emitting loop further includes a seventh switch tube. The seventh switch tube is electrically coupled in series between the drive transistor and the light-emitting element, and a circuit formed by the seventh switch tube and the light-emitting element which are coupled in series is electrically coupled in parallel with the first switch tube. In the reset phase, the seventh switch tube is switched off to make the light-emitting loop disconnected. In the light-emitting phase, the seventh switch tube is switched on according to a fifth scan signal received at a control end of the seventh switch tube, to conduct the light-emitting loop.

Optionally, the light-emitting loop further includes a light-emitting loop. The light-emitting loop includes a third switch tube, the drive transistor, a seventh switch tube, and the light-emitting element which are sequentially coupled in series. A first connection end of the third switch tube is configured to receive the reset voltage in the reset phase, and a second connection end of the third switch tube is electrically coupled with the drive transistor. The seventh switch tube is electrically coupled in series between the drive transistor and the light-emitting element, and a circuit formed by the seventh switch tube and the light-emitting element which are coupled in series is electrically coupled in parallel with the first switch tube. In the reset phase, the seventh switch tube is switched off to make the light-emitting loop disconnected. In a light-emitting phase, the third switch tube is switched on according to a second scan signal received at a control end of the third switch tube, and the seventh switch tube is switched on according to a fifth scan signal received at a control end of the seventh switch tube, to conduct the light-emitting loop to receive a drive voltage to drive the light-emitting element to emit lights.

The disclosure further provides a display panel. The display panel includes a substrate and multiple pixel drive circuits. The substrate has a display region. The multiple pixel drive circuits are arranged in an array in the display region of the substrate. The pixel drive circuit includes a light-emitting element, a drive transistor, a reset loop, a first capacitor, a first switch tube, a second capacitor, a pre-charge module, and a threshold compensation loop. A first end of the light-emitting element is electrically coupled with a reference-voltage end. The pixel drive circuit is configured to drive the light-emitting element to emit lights. The drive transistor is electrically coupled with a second end of the light-emitting element. A first end of the first capacitor is electrically coupled with a control end of the drive transistor. The first capacitor is arranged in the reset loop. The reset loop is conductive in a reset phase to receive a reset voltage, to charge the first capacitor to raise a voltage at the first end of the first capacitor, so as to reset a voltage at the control end of the drive transistor to the reset voltage through the first capacitor. The first switch tube is coupled in parallel at two ends of the light-emitting element. A first end of the second capacitor is electrically coupled with a control end of the first switch tube. The pre-charge module is electrically coupled with the first end of the second capacitor, and configured to charge the second capacitor in the reset phase to raise a voltage at the first end of the second capacitor to a first voltage, where the first voltage is lower than a sum of a voltage at the reference-voltage end and a threshold voltage of the first switch tube. The threshold compensation loop includes the first capacitor, the drive transistor, and the first switch tube which are electrically coupled in series. The second capacitor continues to be charged according to a first scan signal in a threshold compensation phase, such that a voltage at the control end of the first switch tube is raised continuously from the first voltage to switch on the first switch tube, so as to conduct the threshold compensation loop. The first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

Additional aspects and advantages of the disclosure will be illustrated in part from the following description, and the other part of the additional aspects and the advantages of the disclosure will become apparent from the following description, or may be learned by practice of the disclosure.

Referring to FIG. 1, the disclosure provides a display panel 1. The display panel 1 includes a substrate 1000. The substrate 1000 has a display region 1001 and a non-display region 1002. Multiple pixel drive circuits 100 are arranged in an array in the display region 1001, and each pixel drive circuit 100 constitutes a pixel unit. A scan-signal generation circuit 110 (also called a gate driver) is disposed in the non-display region 1002. The scan-signal generation circuit 110 is electrically coupled with pixel drive circuits 100 in each row through multiple scan lines 111, and configured to generate several corresponding scan signals for pixel drive circuits 100 in each row.

In implementations of the disclosure, the display panel 1 further includes a data-signal generation circuit 120 (also called a source driver). The data-signal generation circuit 120 is electrically coupled with pixel drive circuits 100 in each column through multiple data lines 121. The data-signal generation circuit 120 is configured to generate a corresponding data signal DATA for pixel drive circuits in each column, and output the data signal DATA to each of pixel drive circuits 100 in each column.

Figure 2:
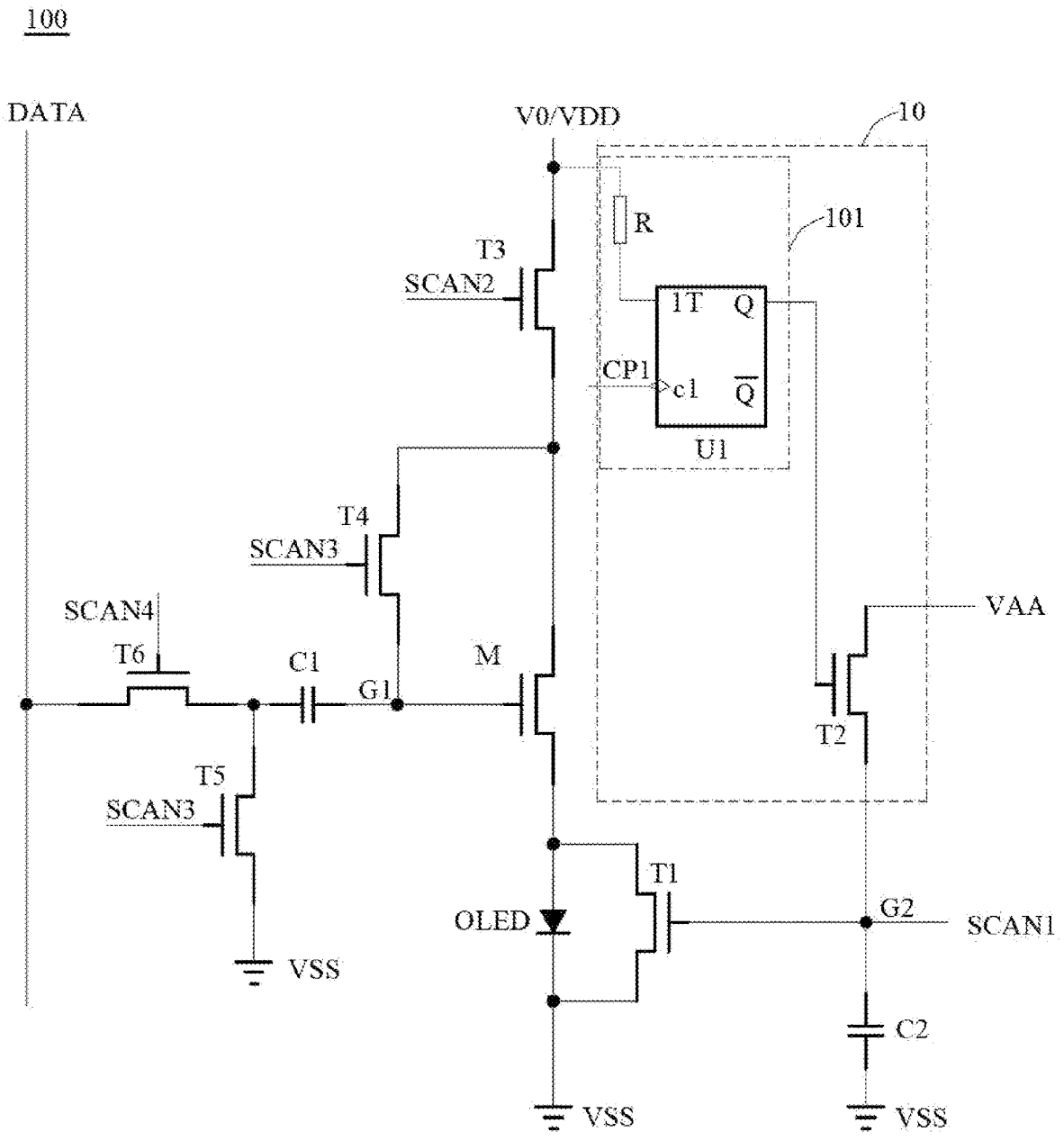
FIG. 2 is a schematic structural diagram illustrating a pixel drive circuit provided in implementations of the disclosure.

Specifically, referring to FIG. 2, the pixel drive circuit 100 includes a light-emitting element OLED. The pixel drive circuit 100 is configured to drive the light-emitting element to emit lights. In implementations of the disclosure, the light-emitting element is an Organic Light-Emitting Diode (OLED), where a first end of the light-emitting element is a cathode of the OLED, and a second end of the light-emitting element is an anode of the OLED. In other implementations, the light-emitting element may also be a Light-Emitting Diode (LED), Micro LED, Mini LED, or the like.

A circuit structure and a working principle of the pixel drive circuit 100 will be depicted below with reference to FIG. 3 and FIG. 4*a* to FIG. 4*d*.

Figure 3:
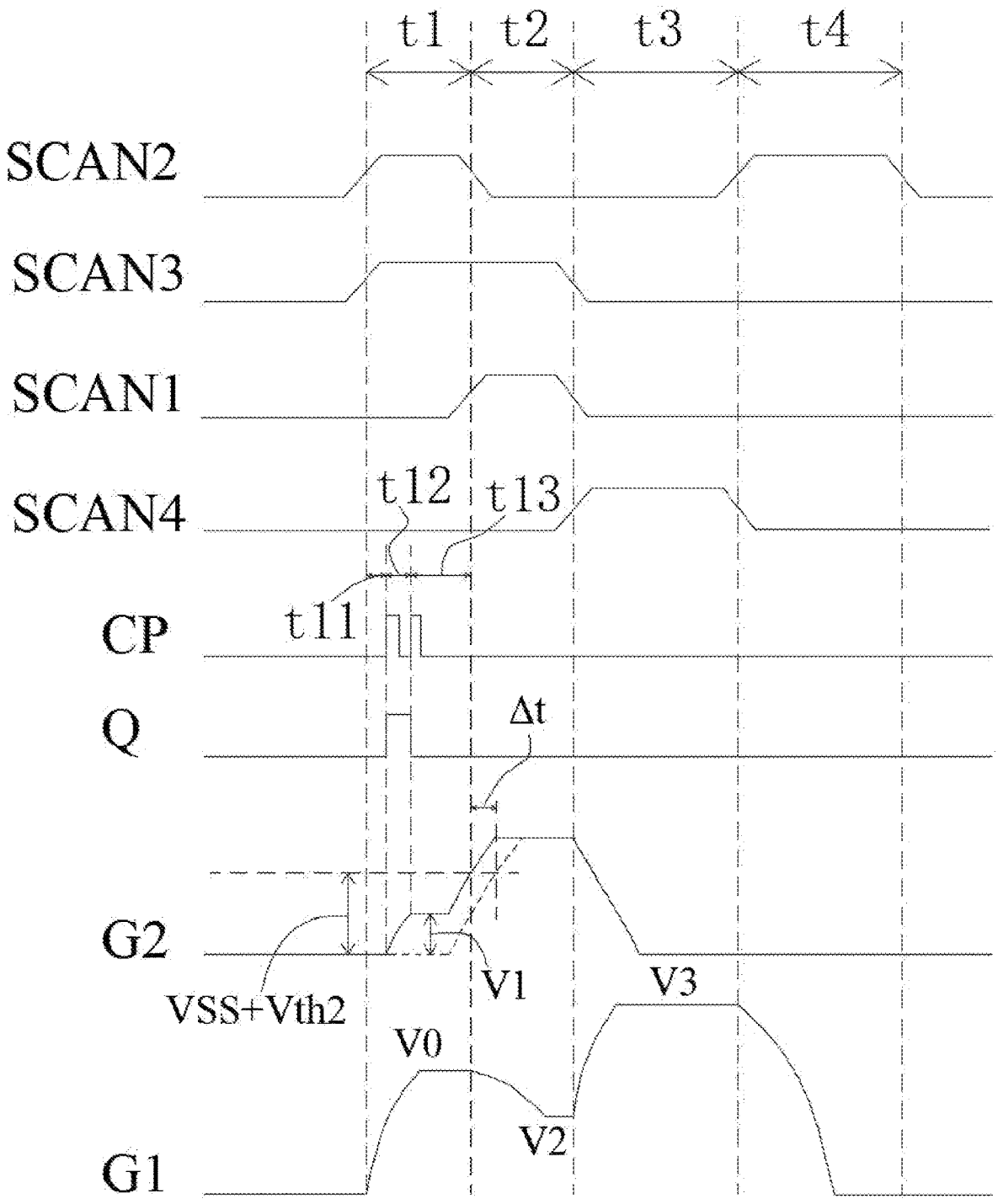
FIG. 3 is a working timing-diagram of the pixel drive circuit illustrated in FIG. 2.

As illustrated in FIG. 3, the pixel drive circuit 100 sequentially operates in a reset phase (t1 phase), a threshold compensation phase (t2 phase), a data-writing phase (t3 phase), and a light-emitting phase (t4 phase) in one frame of scan period.

Figure 4A:
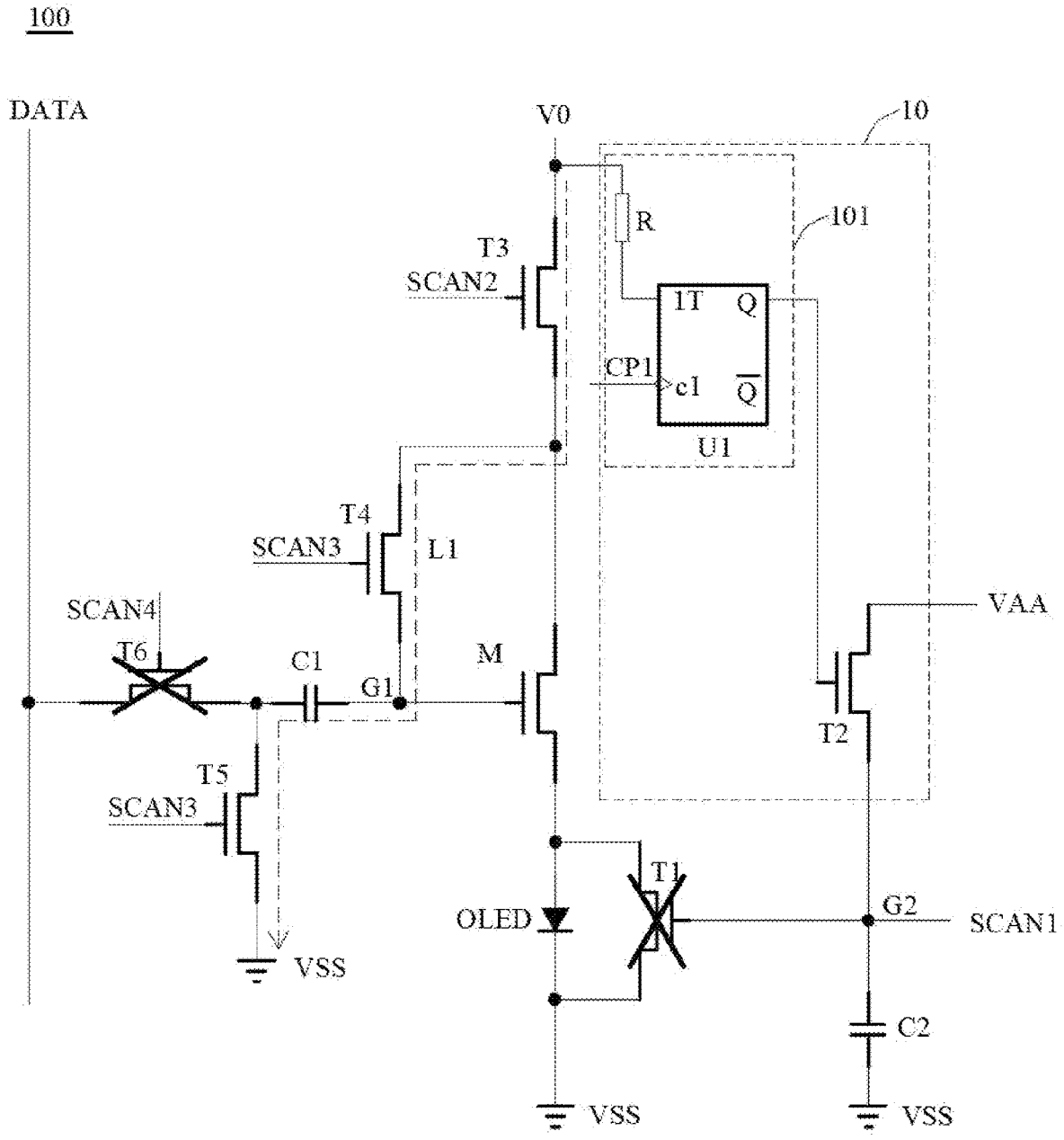
FIG. 4*a* is a schematic circuit diagram of the pixel drive circuit illustrated in FIG. 2 in t1 phase.

As illustrated in FIG. 4*a*, the pixel drive circuit 100 includes a reset loop L1. The reset loop L1 includes a third switch tube T3, a fourth switch tube T4, a first capacitor C1, and a fifth switch tube T5 which are sequentially coupled in series. Specifically, a first connection end of the third switch tube T3 is configured to receive a reset voltage V0 in the reset phase, a second connection end of the third switch tube T3 is electrically coupled with a first connection end (i.e., drain) of a drive transistor M and a first connection end of the fourth switch tube T4, a second connection end of the fourth switch tube T4 is electrically coupled with a control end (i.e., gate) of the drive transistor M and a first end of the first capacitor C1, a second end of the first capacitor C1 is electrically coupled with a first connection end of the fifth switch tube T5, and a second connection end of the fifth switch tube T5 is electrically coupled with a reference-voltage end VSS. In implementations of the disclosure, a connection node between the control end of the drive transistor M and the first end of the first capacitor C1 is marked as a first node G1. The reference-voltage end VSS is configured to output a reference voltage VSS. In implementations of the disclosure, a potential of the reference voltage VSS is a low level, for example, a ground potential.

Figure 4B:
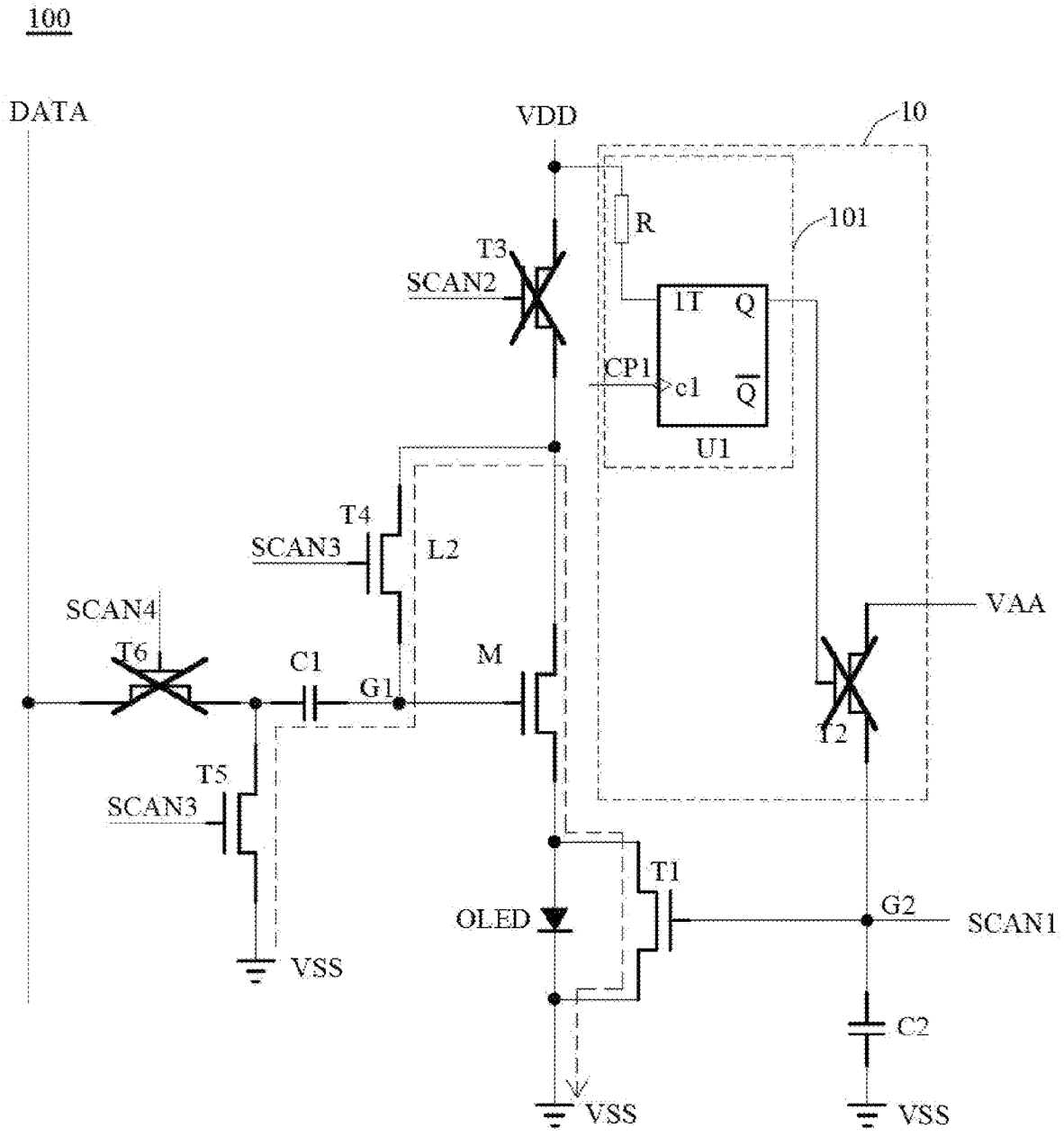
FIG. 4*b* is a schematic circuit diagram of the pixel drive circuit illustrated in FIG. 2 in t2 phase.
Figure 4C:
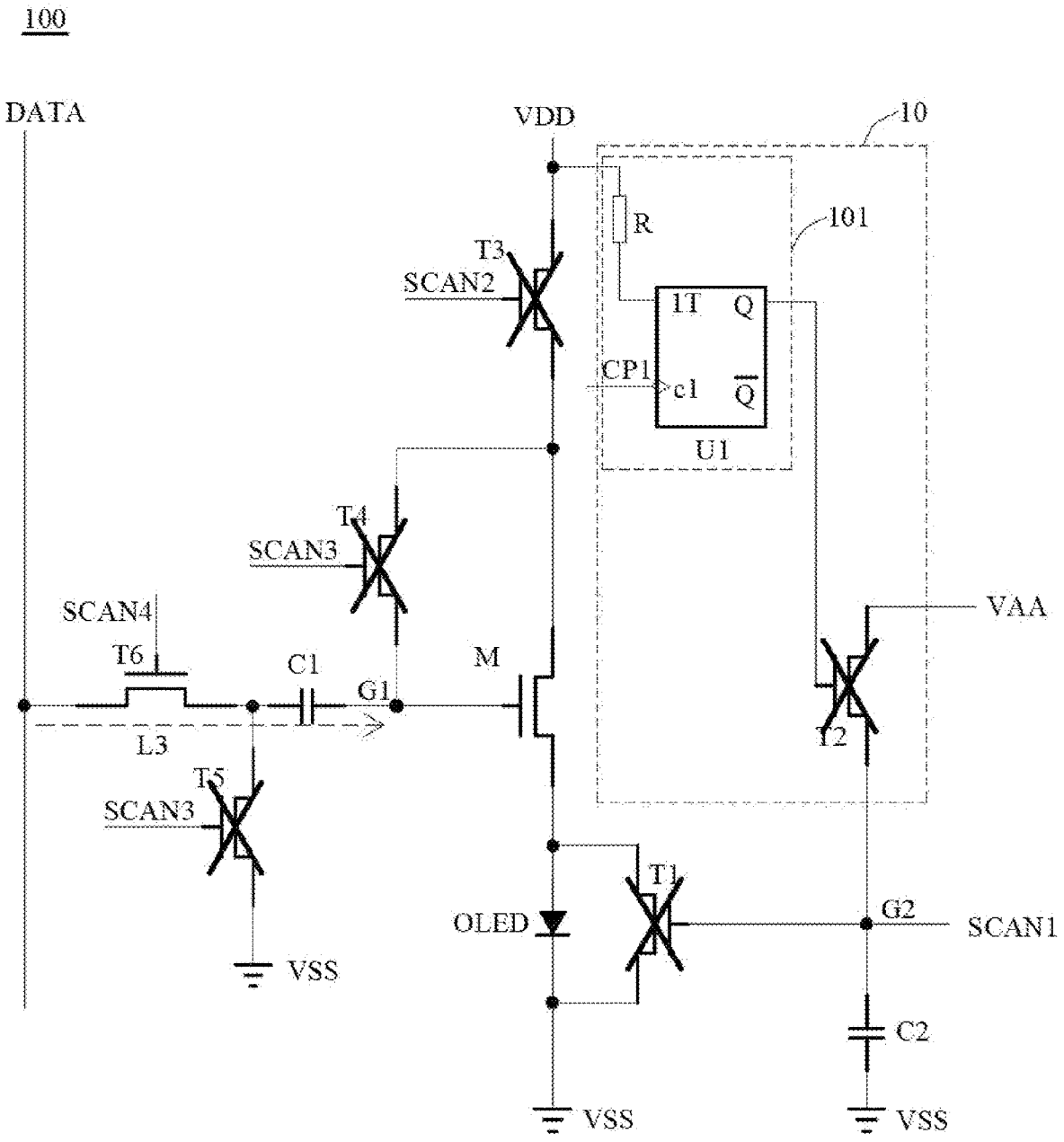
FIG. 4*c* is a schematic circuit diagram of the pixel drive circuit illustrated in FIG. 2 in t3 phase.
Figure 4D:
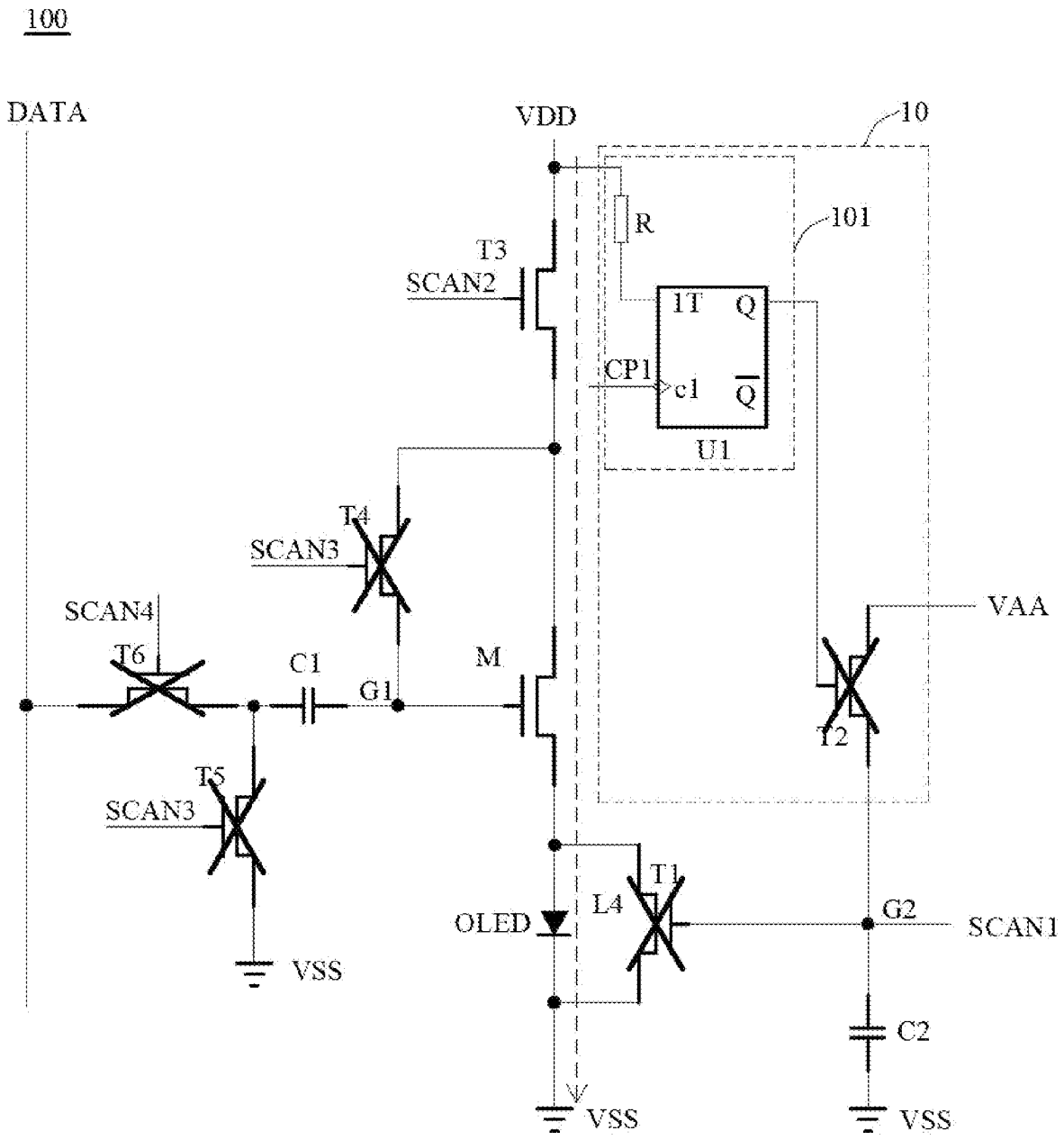
FIG. 4*d* is a schematic circuit diagram of the pixel drive circuit illustrated in FIG. 2 in t4 phase.

Further, referring to FIG. 4*d*, the pixel drive circuit 100 further includes a light-emitting loop L4. The light-emitting loop L4 includes the third switch tube T3, the drive transistor M, and a light-emitting element OLED which are sequentially coupled in series. A first end of the light-emitting element OLED is electrically coupled with the reference-voltage end VSS, and a second end of the light-emitting element OLED is electrically coupled with a second connection end (i.e., source) of the drive transistor M.

As illustrated in FIG. 4*a*, in the reset phase, the third switch tube T3 is switched on according to a second scan signal SCAN2 received at a control end of the third switch tube T3, the fourth switch tube T4 is switched on according to a third scan signal SCAN3 received at a control end of the fourth switch tube T4, and the fifth switch tube T5 is switched on according to the third scan signal SCAN3 received at a control end of the fifth switch tube T5, to conduct the reset loop L1 to receive the reset voltage V0, to charge the first capacitor C1 to raise a voltage at the first end of the first capacitor C1, so as to reset a voltage at the control end of the drive transistor M to the reset voltage V0 through the first capacitor C1. In this situation, a gate voltage of the drive transistor M is Vg=V0, and a source voltage of the drive transistor M is $Vs=V_{OLED}$, and therefore, the drive transistor M is switched on because a gate-to-source voltage Vgs is higher than a threshold voltage Vth1 of the drive transistor M. The drive transistor M and the switch tubes T3-T5 each are a high-level on transistor, such as an N-channel Metal-Oxide Semiconductor (NMOS) transistor. In other implementations, the drive transistor M and the switch tubes T3-T5 each are a low-level on transistor, such as a P-channel Metal-Oxide Semiconductor (PMOS) transistor. The drive transistor M and the switch tubes T3-T5 each may be an amorphous silicon Thin-Film Transistor (a-Si TFT), or a low-temperature polycrystalline silicon (LTPS) TFT, or an oxide TFT. An active layer of the oxide TFT is made of oxide, such as Indium Gallium Zinc Oxide (IGZO). The second scan signal SCAN2 and the third scan signal SCAN3 each are a high-level signal.

In the reset phase, the light-emitting loop L4 is conductive because the third switch tube T3 and the drive transistor M each are switched on, and thus, the light-emitting element OLED emits lights for a short time. A luminous duration is too short to be sensed by human eyes.

It should be noted that, in an actual product, scan lines are relatively long, which will lead to resistance-capacitance (RC) loading. Therefore, when the scan-signal generation circuit 110 switches from outputting a low-level signal to outputting a high-level signal through the scan line to the pixel drive circuit 100, the scan line needs to be charged first, that is, a voltage on the scan line needs to be charged for a certain time to rise from a low level to a high level. Similarly, when the scan-signal generation circuit 110 switches from outputting a high-level signal to outputting a low-level signal through the scan line to the pixel drive circuit 100, the scan line needs to be discharged first, that is, a voltage on the scan line needs to be discharged for a certain time to drop from a high level to a low level. Therefore, a scan signal received by the pixel drive circuit 100 is not an ideal square wave, but a trapezoidal wave illustrated in FIG. 3.

In implementations of the disclosure, the pixel drive circuit 100 further includes a first switch tube T1, a second capacitor C2, and a pre-charge module 10. The first switch tube T1 is electrically coupled in parallel at two ends of the light-emitting element OLED, a first end of the second capacitor C2 is electrically coupled with a control end of the first switch tube T1, and a second end of the second capacitor C2 is electrically coupled with the reference-voltage end VSS. The pre-charge module 10 is configured to pre-charge the second capacitor C2 in the reset phase. Specifically, the pre-charge module 10 is configured to charge the second capacitor C2 by receiving a charging voltage VAA within a preset time period in the reset phase, to raise a voltage at the first end of the second capacitor C2 to a first voltage V1, where the first voltage V1 is lower than a sum of a voltage VSS at the reference-voltage end and a threshold voltage Vth2 of the first switch tube T1, in other words, a gate-to-source voltage of the first switch tube T1 is (V1−VSS) (lower than the threshold voltage Vth2 of the first switch tube T1), and thus, the first switch tube T1 is always in an off-state in the reset phase to prevent the display panel 1 from being short-circuited. The first switch tube T1 may be a high-level on transistor, such as an NMOS.

The pre-charge module 10 may include a second switch tube T2 and a switch-on signal generation module 101. In implementations of the disclosure, a connection node between a second connection end of the second switch tube T2 and the first end of the second capacitor C2 is marked as a second node G2.

A first connection end of the second switch tube T2 is configured to receive the charging voltage VAA, and the second connection end of the second switch tube T2 is electrically coupled with a control end of the first switch tube T1. The switch-on signal generation module 101 is electrically coupled with the control end of the second switch tube T2, and configured to generate a switch-on signal within the preset time period in the reset phase to switch on the second switch tube T2, such that the second capacitor C2 can be charged by receiving the charging voltage VAA through the switched-on second switch tube T2, and the first end of the second capacitor C2 is charged to the first voltage V1.

In these implementations, the t1 phase includes a t11 phase, a t12 phase, and a t13 phase. The switch-on signal generation module 101 includes a T flip flop U1. A clock-signal end cl of the T flip flop U1 is configured to receive a first clock signal CP1 within the preset time period in the reset phase, an input end 1T of the T flip flop U1 is configured to receive a high-level voltage, and an output end Q of the T flip flop U1 is coupled with the control end of the second switch tube T2. In implementations of the disclosure, the input end 1T of the T flip flop U1 is electrically coupled with the first connection end of the third switch tube T3 through a resistor R to receive the high-level voltage, and a duration of the first clock signal CP1 is two preset clock cycles, that is, the first clock signal CP1 includes pulse signals of two clock cycles. The resistor R is a current limiting resistor for protecting the T flip flop U1. Exemplarily, a resistance value of the resistor R is in a range of 100Ω to 1KΩ.

In the t11 phase, the input end 1T of the T flip flop U1 receives a high-level voltage, and the output end Q of the T flip flop U1 outputs a low level when no pulse signal is inputted, so that the second switch tube T2 is switched off. When a first pulse signal of the first clock signal CP1 arrives, the T flip flop U1 enters into the t12 phase, and outputs a switch-on signal through the output end Q of the T flip flop U1, so that the second switch tube T2 is switched on. When a second pulse signal of the first clock signal CP1 arrives, the T flip flop U1 enters into the t13 phase, and stops outputting of the switch-on signal, so that the second switch tube T2 is switched off In the t12 phase, the second switch tube T2 is switched on and transmits the charging voltage VAA to charge the second capacitor, to raise a voltage at the first end of the second capacitor C2 to a first voltage V1. In t11, t13, and t2-t4 phases, the second switch tube T2 is always in an off-state. In implementations of the disclosure, the second switch tube T2 is a high-level on transistor, and the switch-on signal is a high-level signal. It can be understood that, by adjusting a voltage value of the charging voltage VAA and/or a period of the first clock signal CP1, the first end of the second capacitor C2 can be charged to the preset first voltage V1 in the t12 phase. It should be noted that, in other implementations, the t1 phase includes only the t12 phase, or includes only the t11 phase and the t12 phase, or includes only the t12 phase and the t13 phase, which is not limited herein.

As illustrated in FIG. 4*b*, the pixel drive circuit 100 further includes a threshold compensation loop L2. The threshold compensation loop L2 includes the fifth switch tube T5, the first capacitor C1, and the fourth switch tube T4, the drive transistor M, and the first switch tube T1 which are sequentially coupled in series.

In the threshold compensation phase, the fourth switch tube T4 is switched on according to the third scan signal SCAN3 received at a control end of the fourth switch tube T4, and the fifth switch tube T5 is switched on according to the third scan signal SCAN3 received at a control end of the fifth switch tube T5. The second capacitor C2 continues to be charged according to a first scan signal SCAN1, so that a voltage at the control end of the first switch tube T1 continuously rises from the first voltage V1. When a drain-to-source voltage of the first switch tube T1 is higher than the threshold voltage Vth2 of the first switch tube T1 (i.e., when the voltage at the control end of the first switch tube T1 is higher than (VSS+Vth2)), the first switch tube T1 enters into an on-state, so as to conduct the threshold compensation loop L2. The first capacitor C1 is discharged through the conductive threshold compensation loop L2, to make the voltage at the control end (i.e., the first node G1) of the drive transistor M gradually drop from the reset voltage V0 to a second voltage V2 (in this situation, a gate-to-source voltage Vgs of the drive transistor M is equal to Vth1, that is, Vgs=Vth1), and thus, the drive transistor M enters into a critical on-state. As such, the voltage at the first end of the first capacitor C1 is maintained at the second voltage V2, which can realize compensation for the threshold voltage of the drive transistor M. The second voltage V2 is lower than or equal to the reset voltage V0, V2=VSS+Vth1. In the threshold compensation phase, the light-emitting element OLED is short-circuited by the switched-on first switch tube T1, and does not emit lights.

According to the pixel drive circuit 100 of the disclosure, the first end of the second capacitor C2 is pre-charged to the first voltage V1 through the pre-charge module 10 in the reset phase, when receiving the first scan signal SCAN1, the second capacitor C2 can continue to be charged from the first voltage V1, rather than starting to be charged from an initial low level (e.g., 0V). As such, a duration of the t2 phase can be shortened by Δt, that is, each frame of scan period can be shortened by Δt, which is conducive to achieving a high refresh rate.

As illustrated in FIG. 4*c*, the pixel drive circuit 100 further includes a data-writing loop L3. The data-writing loop L3 includes a sixth switch tube T6 and the first capacitor C1 which are electrically coupled in series. A first connection end of the sixth switch tube T6 is configured to receive a data signal DATA, and a second connection end of the sixth switch tube T6 is electrically coupled with a second end of the first capacitor C1, where a voltage of the data signal DATA is a data voltage $V_{DATA}$.

In the data-writing phase, switch tubes T1-T5 each are switched off, and the sixth switch tube T6 is switched on according to a fourth scan signal SCAN4 received at a control end of the sixth switch tube T6, to conduct the data-writing loop L3 to pull up a voltage at the second end of the first capacitor C1 to the data voltage $V_{DATA}$. In the data-writing phase, a voltage at the second end of the first capacitor C1 varies by ($V_{DATA}$-VSS). A voltage variation at the first end of the first capacitor C1 should be equal to the voltage variation at the second end of the first capacitor C1 due to a coupling effect of the first capacitor C1, and therefore, the voltage at the first end of the first capacitor C1 is pulled up to a third voltage V3, where V3=($V_{DATA}$−VSS)+V2=$V_{DATA}$+Vth1. The fourth scan signal SCAN4 is a high-level signal.

As illustrated in FIG. 4*d*, in the light-emitting phase, the third switch tube T3 is switched on according to the second scan signal SCAN2 received at the control end of the third switch tube T3, and receives the drive voltage VDD through the first connection end of the third switch tube T3, to conduct a light-emitting loop L4 to drive the light-emitting element OLED to emit lights with the received drive voltage VDD. In these implementations, the reset voltage V0 received at the third switch tube T3 in the reset phase is equal to the drive voltage VDD received at the third switch tube T3 in the light-emitting phase. In other implementations, the reset voltage V0 may also be lower than the drive voltage VDD.

Specifically, for the drive transistor M, in the light-emitting phase, the gate voltage of the drive transistor M Vg=V3=$V_{DATA}$+Vth1 and the source voltage of the drive transistor M Vs=VSS+$V_{OLED}$, in this situation, a gate-to-source voltage of the drive transistor M Vgs=Vg−Vs=$V_{DATA}$+Vth1−VSS−$V_{OLED}$>$V_{th1}$, and therefore, the drive transistor M is switched on.

In addition, in implementations of the disclosure, in the light-emitting phase, since the third switch tube T3 works in a linear region and the drive transistor M works in a saturation region, a magnitude of the current flowing through the light-emitting element OLED mainly depends on a current Ids between the source of the drive transistor M and the drain of the drive transistor M. According to working characteristics of the transistor, the current Ids and the gate-to-source voltage Vgs satisfy the following relationship:

$$Ids=(K/2)(Vgs-Vth1)^2=(K/2)(V_{DATA}-VSS-V_{OLED})^2$$

where K=Cox×μ×W/L, Cox represents a gate capacitance per unit area, u represents an electron mobility in a channel, and W/L represents a width-to-length ratio of the channel of the drive transistor M.

Based on the above formula, the voltage at the control end of the drive transistor M can be compensated to the second voltage V2 through the threshold compensation loop L3 in the threshold compensation phase, so that the current Ids flowing through the light-emitting element OLED is unrelated to the threshold voltage Vth1 of the drive transistor M. As such, on the one hand, the current Ids can be increased to improve luminance of the light emitting element OLED; on the other hand, a phenomenon of uneven display brightness caused by differences in threshold voltages Vth1 of drive transistors M of different drive circuits can be eliminated.

Figure 5:
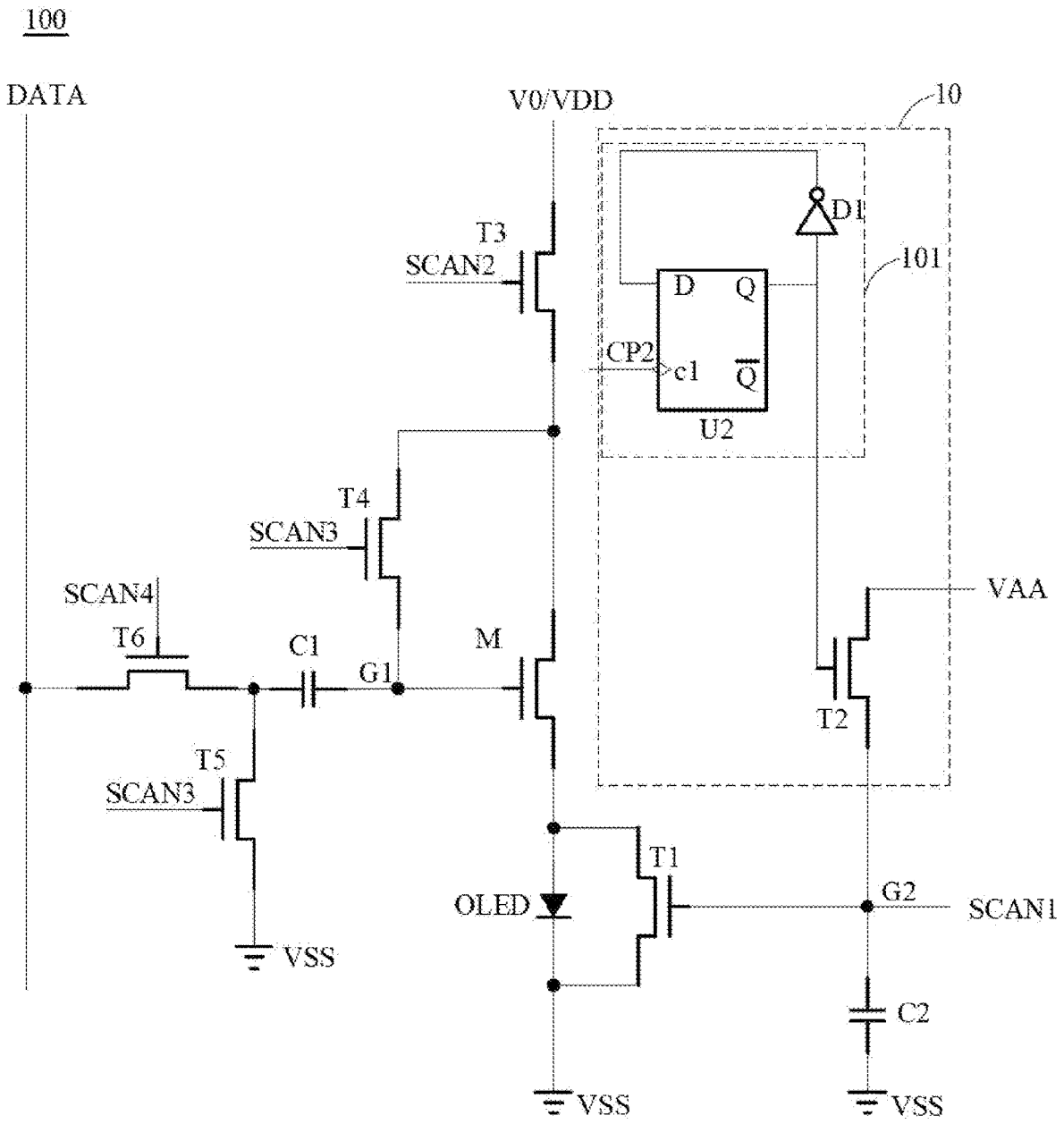
FIG. 5 is a schematic structural diagram illustrating a pixel drive circuit provided in other implementations of the disclosure.
Figure 6:
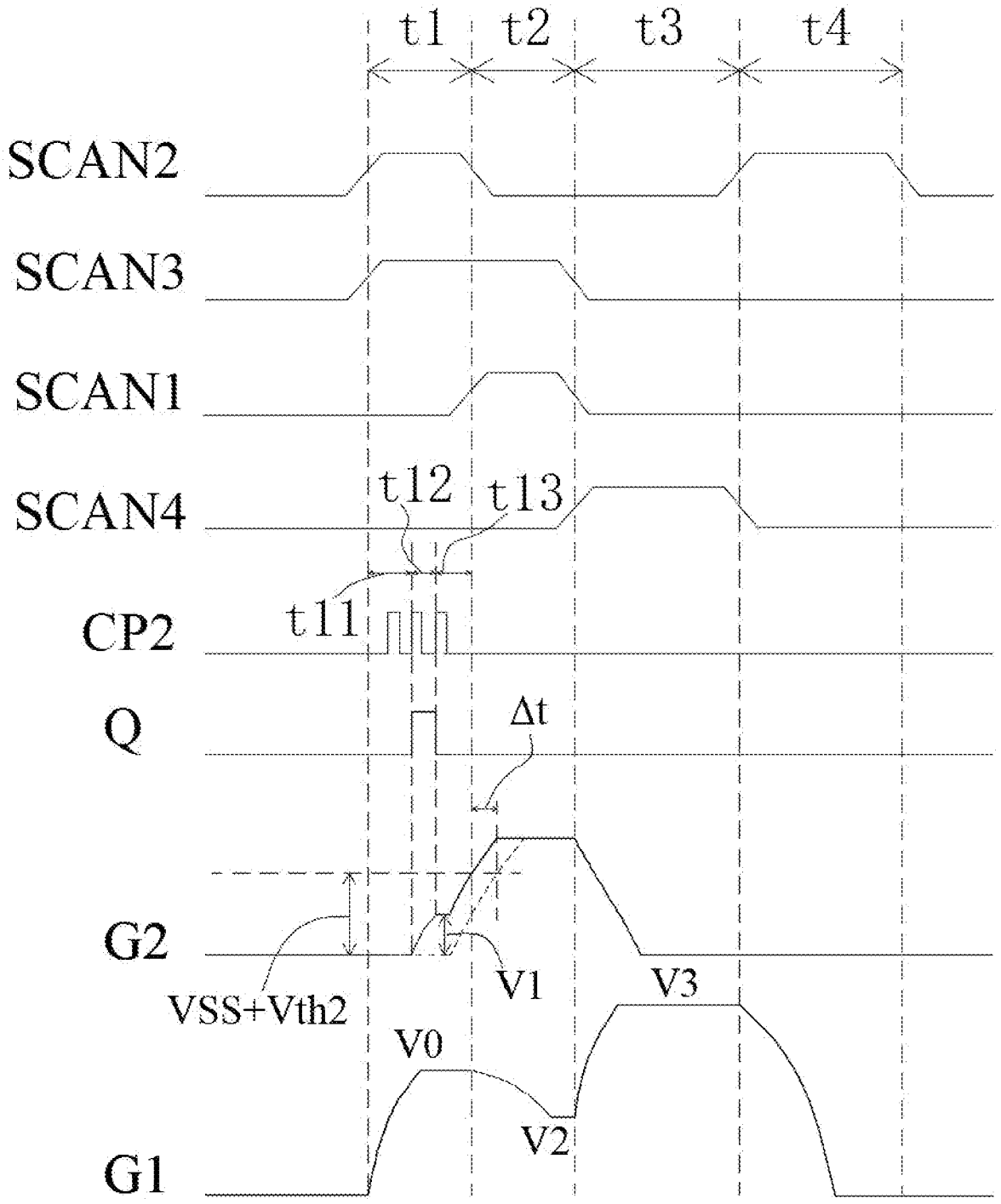
FIG. 6 is a working timing-diagram of the pixel drive circuit illustrated in FIG. 5.

Referring to FIG. 5 and FIG. 6, FIG. 5 is a schematic structural diagram illustrating a pixel drive circuit 100 provided in other implementations of the disclosure, and FIG. 6 is a working timing-diagram of the pixel drive circuit 100 illustrated in FIG. 5. The pixel drive circuit 100 illustrated in FIG. 5 is similar to the pixel drive circuit 100 illustrated in FIG. 2 in circuit structure except that: the switch-on signal generation module 101 illustrated in FIG. 5 includes a D flip flop U2 and an inverter D1. Compared to the T flip flop U1, the D flip flop U2 needs to receive pulse signals of three clock cycles, but the D flip flop U2 has a simpler circuit structure. In other implementations, the switch-on signal generation module 101 may also be a JK flip flop, which is not limited herein.

Specifically, a clock-signal end cl of the D flip flop U2 is configured to receive a second clock signal CP2 within the preset time period in the reset phase, and an output end Q of the D flip flop U2 is electrically coupled with the control end of the second switch tube T2. An input end of the inverter D1 is electrically coupled with the output end Q of the D flip flop U2, and an output end of the inverter D1 is electrically coupled with the input end D of the D flip flop U2. In implementations of the disclosure, a duration of the second clock signal CP2 is three preset clock cycles, that is, the second clock signal CP2 includes pulse signals of three clock cycles.

In the t11 phase, before the D flip flop U2 receives the second clock signal CP2, no signal is outputted at the output end Q of the D flip flop U2, and thus, the second switch tube T2 is switched off. When a rising edge of a first pulse signal of the second clock signal CP2 arrives, the D flip flop U2 outputs, according to a low level at the input end D of the D flip flop U2, a low-level signal through the output end Q of the D flip flop U2, so that the second switch tube T2 is still in an off-state. At the same time, the inverter D1 inverts the low-level signal to obtain a high-level signal and outputs the high-level signal to the input end D of the D flip flop U2.

When a rising edge of a second pulse signal of the second clock signal CP2 arrives, the D flip flop U2 enters into the t12 phase, and outputs, according to a high level at the input end D of the D flip flop U2, a switch-on signal through the output end Q of the D flip flop U2, so that the second switch tube T2 is switched on. At the same time, the inverter D1 inverts the switch-on signal to obtain a low-level signal and outputs the low-level signal to the input end D of the D flip flop U2.

When a rising edge of a third pulse signal of the second clock signal CP2 arrives, the D flip flop U2 enters into the t13 phase, and outputs, according to a low level at the input end D of the D flip flop U2, a low-level signal through the output end Q of the D flip flop U2, so that the second switch tube T2 is switched off.

Figure 7:
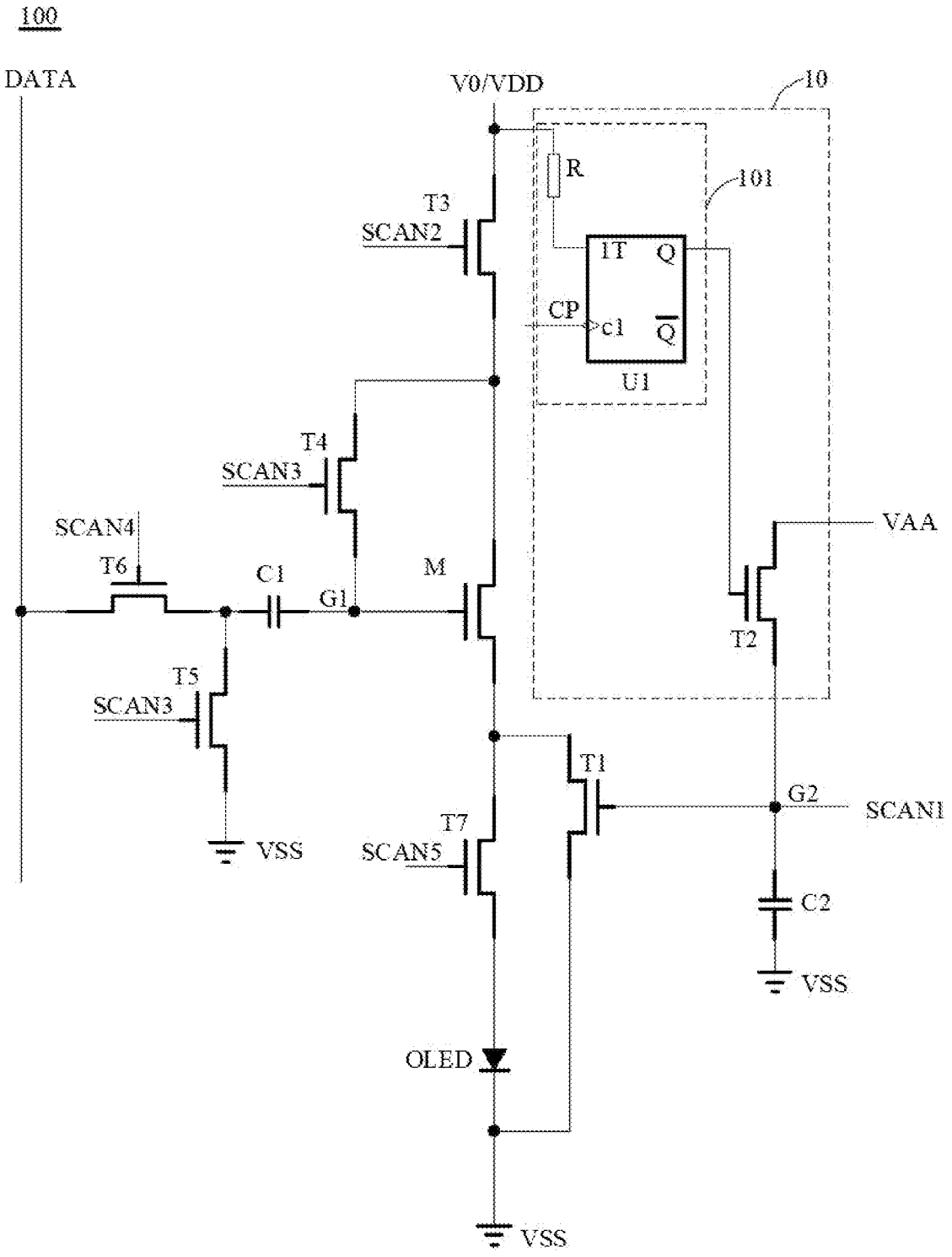
FIG. 7 is a schematic structural diagram illustrating a pixel drive circuit provided in other implementations of the disclosure.
Figure 8:
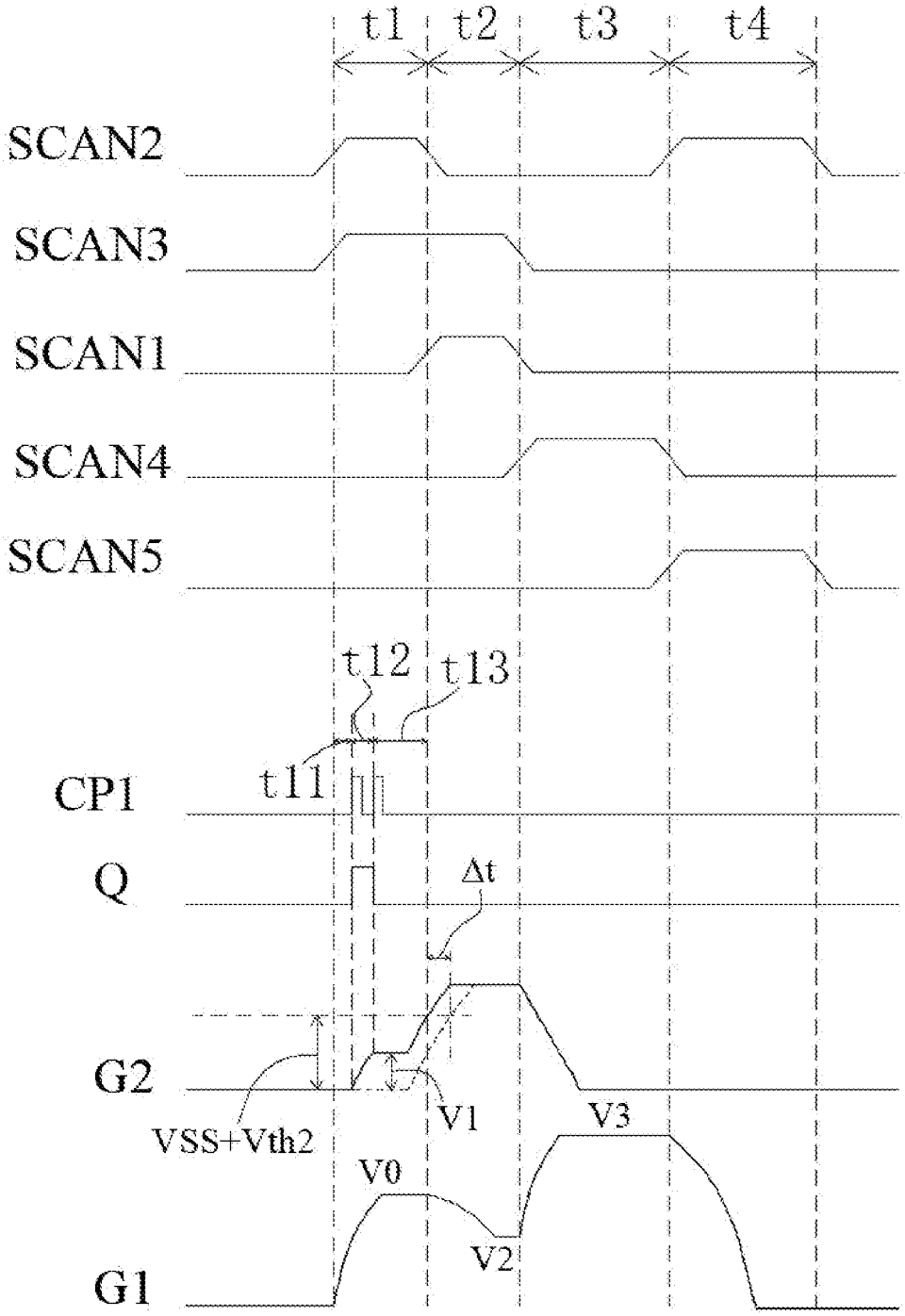
FIG. 8 is a working timing-diagram of the pixel drive circuit illustrated in FIG. 7.

Referring to FIG. 7 and FIG. 8, FIG. 7 is a schematic structural diagram illustrating a pixel drive circuit 100 provided in other implementations of the disclosure, and FIG. 8 is a working timing-diagram of the pixel drive circuit 100 illustrated in FIG. 7. The pixel drive circuit 100 illustrated in FIG. 7 is similar to the pixel drive circuit 100 illustrated in FIG. 2 in circuit structure except that: the light-emitting loop L4 further includes a seventh switch tube T7 which is electrically coupled in series between the drive transistor M and the light-emitting element OLED.

Specifically, a circuit formed by the seventh switch tube T7 and the light-emitting element OLED which are coupled in series is electrically coupled in parallel with the first switch tube T1. That is, a first connection end of the seventh switch tube T7 is electrically coupled with the second connection end of the drive transistor M, and a second connection end of the seventh switch tube T7 is electrically coupled with the anode of the light-emitting element OLED.

In the reset phase, the seventh switch tube T7 is switched off to make the light-emitting loop L4 disconnected. As such, the light-emitting element OLED can be prevented from emitting lights in the reset phase, thereby improving a display effect of the display panel 1.

In the light-emitting phase, the seventh switch tube T7 is switched on according to a fifth scan signal SCAN5 received at a control end of the seventh switch tube T7, to conduct the light-emitting loop L4. The fifth scan signal SCAN5 is a high-level signal.

While the implementations of the disclosure have been illustrated and depicted above, it will be understood by those of ordinary skill in the art that various changes, modifications, substitutions, and alterations can be made to these implementations without departing from the principles and spirits of the disclosure. Therefore, the scope of the disclosure is defined by the appended claims and equivalents of the appended claims.

What is claimed is:

1. A pixel drive circuit, comprising:

a light-emitting element, wherein a first end of the light-emitting element is electrically coupled with a reference-voltage end, and the pixel drive circuit is configured to drive the light-emitting element to emit lights;

a drive transistor, electrically coupled with a second end of the light-emitting element;

a reset loop;

a first capacitor, wherein the first capacitor is coupled in series in the reset loop, a first end of the first capacitor is electrically coupled with a control end of the drive transistor, and the reset loop is conductive in a reset phase to receive a reset voltage, to charge the first capacitor to raise a voltage at the first end of the first capacitor, so as to reset a voltage at the control end of the drive transistor to the reset voltage through the first capacitor;

a first switch tube, coupled in parallel at two ends of the light-emitting element;

a second capacitor, wherein a first end of the second capacitor is electrically coupled with a control end of the first switch tube;

a pre-charge module, electrically coupled with the first end of the second capacitor, and configured to charge the second capacitor in the reset phase to raise a voltage at the first end of the second capacitor to a first voltage, wherein the first voltage is lower than a sum of a voltage at the reference-voltage end and a threshold voltage of the first switch tube; and a threshold compensation loop, comprising the first capacitor, the drive transistor, and the first switch tube which are electrically coupled in series; wherein the second capacitor continues to be charged according to a first scan signal in a threshold compensation phase, such that a voltage at the control end of the first switch tube is raised continuously from the first voltage to switch on the first switch tube, so as to conduct the threshold compensation loop; wherein the first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

2. The pixel drive circuit of claim 1, wherein the pre-charge module comprises:

a second switch tube, wherein a first connection end of the second switch tube is configured to receive a charging voltage, and a second connection end of the second switch tube is electrically coupled with the control end of the first switch tube; and a switch-on signal generation module, electrically coupled with a control end of the second switch tube and configured to generate a switch-on signal within a preset time period in the reset phase to switch on the second switch tube, such that the second capacitor can be charged by receiving the charging voltage through the switched-on second switch tube, and the first end of the second capacitor is charged to the first voltage.

3. The pixel drive circuit of claim 2, wherein the switch-on signal generation module comprises a T flip flop, wherein a clock-signal end of the T flip flop is configured to receive a first clock signal within the preset time period in the reset phase, an input end of the T flip flop is configured to receive a high-level voltage, an output end of the T flip flop is electrically coupled with the control end of the second switch tube, and a duration of the first clock signal is two preset clock cycles; and the T flip flop is configured to generate and output the switch-on signal within the preset time period in the reset phase in response to the first clock signal.

4. The pixel drive circuit of claim 2, wherein the switch-on signal generation module comprises:

a D flip flop, wherein a clock-signal end of the D flip flop is configured to receive a second clock signal within the preset time period in the reset phase, an output end of the D flip flop is electrically coupled with the control end of the second switch tube, and a duration of the second clock signal is three preset clock cycles; and an inverter, wherein an input end of the inverter is electrically coupled with the output end of the D flip flop, and an output end of the inverter is electrically coupled with an input end of the D flip flop;

the D flip flop being configured to generate and output the switch-on signal within the preset time period in the reset phase in response to the second clock signal.

5. The pixel drive circuit of claim 1, wherein the reset loop further comprises a third switch tube, a fourth switch tube, and a fifth switch tube which are coupled in series, wherein a first connection end of the third switch tube is configured to receive the reset voltage in the reset phase, and a second connection end of the third switch tube is electrically coupled with the drive transistor;

the fourth switch tube is electrically coupled between the second connection end of the third switch tube and the control end of the drive transistor;

the fifth switch tube is electrically coupled between a second end of the first capacitor and the reference-voltage end; and in the reset phase, the third switch tube is switched on according to a second scan signal received at a control end of the third switch tube, the fourth switch tube is switched on according to a third scan signal received at a control end of the fourth switch tube, and the fifth switch tube is switched on according to the third scan signal received at a control end of the fifth switch tube, to conduct the reset loop.

6. The pixel drive circuit of claim 5, wherein the threshold comparison loop further comprises the fourth switch tube and the fifth switch tube, wherein in the threshold compensation phase, the fourth switch tube is switched on according to the third scan signal received at the control end of the fourth switch tube, and the fifth switch tube is switched on according to the third scan signal received at the control end of the fifth switch tube, to conduct the threshold compensation loop.

7. The pixel drive circuit of claim 6, further comprising a data-writing loop, wherein the data-writing loop comprises a sixth switch tube and the first capacitor which are electrically coupled in series, wherein a first connection end of the sixth switch tube is configured to receive a data voltage, and a second connection end of the sixth switch tube is electrically coupled with the second end of the first capacitor; and in a data-writing phase, the fifth switch tube is switched off, and the sixth switch tube is switched on according to a fourth scan signal received at a control end of the sixth switch tube, to conduct the data-writing loop to pull up a voltage at the second end of the first capacitor to the data voltage.

8. The pixel drive circuit of claim 7, further comprising a light-emitting loop, wherein the light-emitting loop comprises the third switch tube, the drive transistor, and the light-emitting element which are sequentially coupled in series; and in a light-emitting phase, the third switch tube is switched on according to the second scan signal received at the control end of the third switch tube, to conduct the light-emitting loop to receive a drive voltage to drive the light-emitting element to emit lights.

9. The pixel drive circuit of claim 8, wherein the light-emitting loop further comprises a seventh switch tube, wherein the seventh switch tube is electrically coupled in series between the drive transistor and the light-emitting element, and a circuit formed by the seventh switch tube and the light-emitting element which are coupled in series is electrically coupled in parallel with the first switch tube;

in the reset phase, the seventh switch tube is switched off to make the light-emitting loop disconnected; and in the light-emitting phase, the seventh switch tube is switched on according to a fifth scan signal received at a control end of the seventh switch tube, to conduct the light-emitting loop.

10. The pixel drive circuit of claim 1, further comprising a light-emitting loop, wherein the light-emitting loop comprises a third switch tube, the drive transistor, a seventh switch tube, and the light-emitting element which are sequentially coupled in series;

a first connection end of the third switch tube is configured to receive the reset voltage in the reset phase, and a second connection end of the third switch tube is electrically coupled with the drive transistor;

the seventh switch tube is electrically coupled in series between the drive transistor and the light-emitting element, and a circuit formed by the seventh switch tube and the light-emitting element which are coupled in series is electrically coupled in parallel with the first switch tube;

in the reset phase, the seventh switch tube is switched off to make the light-emitting loop disconnected; and in a light-emitting phase, the third switch tube is switched on according to a second scan signal received at a control end of the third switch tube, and the seventh switch tube is switched on according to a fifth scan signal received at a control end of the seventh switch tube, to conduct the light-emitting loop to receive a drive voltage to drive the light-emitting element to emit lights.

11. A display panel, comprising:

a substrate having a display region; and a plurality of pixel drive circuits arranged in an array in the display region of the substrate, wherein the pixel drive circuit comprises:

a light-emitting element, wherein a first end of the light-emitting element is electrically coupled with a reference-voltage end, and the pixel drive circuit is configured to drive the light-emitting element to emit lights;

a drive transistor, electrically coupled with a second end of the light-emitting element;

a reset loop;

a first capacitor, wherein the first capacitor is coupled in series in the reset loop, a first end of the first capacitor is electrically coupled with a control end of the drive transistor, and the reset loop is conductive in a reset phase to receive a reset voltage, to charge the first capacitor to raise a voltage at the first end of the first capacitor, so as to reset a voltage at the control end of the drive transistor to the reset voltage through the first capacitor;

a first switch tube, coupled in parallel at two ends of the light-emitting element;

a second capacitor, wherein a first end of the second capacitor is electrically coupled with a control end of the first switch tube;

a pre-charge module, electrically coupled with the first end of the second capacitor, and configured to charge the second capacitor in the reset phase to raise a voltage at the first end of the second capacitor to a first voltage, wherein the first voltage is lower than a sum of a voltage at the reference-voltage end and a threshold voltage of the first switch tube; and a threshold compensation loop, comprising the first capacitor, the drive transistor, and the first switch tube which are electrically coupled in series; wherein the second capacitor continues to be charged according to a first scan signal in a threshold compensation phase, such that a voltage at the control end of the first switch tube is raised continuously from the first voltage to switch on the first switch tube, so as to conduct the threshold compensation loop; wherein the first capacitor is discharged through the conductive threshold compensation loop, to make the voltage at the control end of the drive transistor drop from the reset voltage to a second voltage, the drive transistor enters into a critical on-state when the voltage at the control end of the drive transistor is equal to the second voltage, and the second voltage is lower than or equal to the reset voltage.

12. The display panel of claim 11, wherein the pre-charge module comprises:

a second switch tube, wherein a first connection end of the second switch tube is configured to receive a charging voltage, and a second connection end of the second switch tube is electrically coupled with the control end of the first switch tube; and a switch-on signal generation module, electrically coupled with a control end of the second switch tube and configured to generate a switch-on signal within a preset time period in the reset phase to switch on the second switch tube, such that the second capacitor can be charged by receiving the charging voltage through the switched-on second switch tube, and the first end of the second capacitor is charged to the first voltage.

13. The display panel of claim 12, wherein the switch-on signal generation module comprises a T flip flop, wherein a clock-signal end of the T flip flop is configured to receive a first clock signal within the preset time period in the reset phase, an input end of the T flip flop is configured to receive a high-level voltage, an output end of the T flip flop is electrically coupled with the control end of the second switch tube, and a duration of the first clock signal is two preset clock cycles; and the T flip flop is configured to generate and output the switch-on signal within the preset time period in the reset phase in response to the first clock signal.

14. The display panel of claim 12, wherein the switch-on signal generation module comprises:

a D flip flop, wherein a clock-signal end of the D flip flop is configured to receive a second clock signal within the preset time period in the reset phase, an output end of the D flip flop is electrically coupled with the control end of the second switch tube, and a duration of the second clock signal is three preset clock cycles; and an inverter, wherein an input end of the inverter is electrically coupled with the output end of the D flip flop, and an output end of the inverter is electrically coupled with an input end of the D flip flop;

the D flip flop being configured to generate and output the switch-on signal within the preset time period in the reset phase in response to the second clock signal.

15. The display panel of claim 11, wherein the reset loop further comprises a third switch tube, a fourth switch tube, and a fifth switch tube which are coupled in series, wherein a first connection end of the third switch tube is configured to receive the reset voltage in the reset phase, and a second connection end of the third switch tube is electrically coupled with the drive transistor;

the fourth switch tube is electrically coupled between the second connection end of the third switch tube and the control end of the drive transistor;

the fifth switch tube is electrically coupled between a second end of the first capacitor and the reference-voltage end; and in the reset phase, the third switch tube is switched on according to a second scan signal received at a control end of the third switch tube, the fourth switch tube is switched on according to a third scan signal received at a control end of the fourth switch tube, and the fifth switch tube is switched on according to the third scan signal received at a control end of the fifth switch tube, to conduct the reset loop.

16. The display panel of claim 15, wherein the threshold comparison loop further comprises the fourth switch tube and the fifth switch tube, wherein in the threshold compensation phase, the fourth switch tube is switched on according to the third scan signal received at the control end of the fourth switch tube, and the fifth switch tube is switched on according to the third scan signal received at the control end of the fifth switch tube, to conduct the threshold compensation loop.

17. The display panel of claim 16, wherein the pixel drive circuit further comprises a data-writing loop, wherein the data-writing loop comprises a sixth switch tube and the first capacitor which are electrically coupled in series, wherein a first connection end of the sixth switch tube is configured to receive a data voltage, and a second connection end of the sixth switch tube is electrically coupled with the second end of the first capacitor; and in a data-writing phase, the fifth switch tube is switched off, and the sixth switch tube is switched on according to a fourth scan signal received at a control end of the sixth switch tube, to conduct the data-writing loop to pull up a voltage at the second end of the first capacitor to the data voltage.

18. The display panel of claim 17, wherein the pixel drive circuit further comprises a light-emitting loop, wherein the light-emitting loop comprises the third switch tube, the drive transistor, and the light-emitting element which are sequentially coupled in series; and in a light-emitting phase, the third switch tube is switched on according to the second scan signal received at the control end of the third switch tube, to conduct the light-emitting loop to receive a drive voltage to drive the light-emitting element to emit lights.

19. The display panel of claim 18, wherein the light-emitting loop further comprises a seventh switch tube, wherein the seventh switch tube is electrically coupled in series between the drive transistor and the light-emitting element, and a circuit formed by the seventh switch tube and the light-emitting element which are coupled in series is electrically coupled in parallel with the first switch tube;

in the reset phase, the seventh switch tube is switched off to make the light-emitting loop disconnected; and in the light-emitting phase, the seventh switch tube is switched on according to a fifth scan signal received at a control end of the seventh switch tube, to conduct the light-emitting loop.

20. The display panel of claim 11, wherein the pixel drive circuit further comprises a light-emitting loop, wherein the light-emitting loop comprises a third switch tube, the drive transistor, a seventh switch tube, and the light-emitting element which are sequentially coupled in series;

a first connection end of the third switch tube is configured to receive the reset voltage in the reset phase, and a second connection end of the third switch tube is electrically coupled with the drive transistor;

the seventh switch tube is electrically coupled in series between the drive transistor and the light-emitting element, and a circuit formed by the seventh switch tube and the light-emitting element which are coupled in series is electrically coupled in parallel with the first switch tube;

in the reset phase, the seventh switch tube is switched off to make the light-emitting loop disconnected; and in a light-emitting phase, the third switch tube is switched on according to a second scan signal received at a control end of the third switch tube, and the seventh switch tube is switched on according to a fifth scan signal received at a control end of the seventh switch tube, to conduct the light-emitting loop to receive a drive voltage to drive the light-emitting element to emit lights.

* * * * *